United States Patent [19]

Virgin

[11] 4,341,936

[45] Jul. 27, 1982

[54] ELECTROMAGNETIC INDUCTION ENERGY CONVERTER

[76] Inventor: George C. Virgin, North Rd., Tivoli, N.Y. 12583

[21] Appl. No.: 104,367

[22] Filed: Dec. 17, 1979

[51] Int. Cl.[3] ..... H05B 5/08

[52] U.S. Cl. ..... 219/10.51; 219/10.77; 219/10.79

[58] Field of Search ..... 219/10.49, 10.51, 10.79, 219/300, 10.75, 10.77

[56] References Cited

U.S. PATENT DOCUMENTS

| | | | |
|---|---|---|---|
| 1,362,622 | 12/1920 | Hendricks, Jr. | 219/10.51 |
| 1,425,968 | 8/1922 | Holmes | 219/10.51 |
| 1,513,087 | 10/1924 | Buhl et al. | 219/10.51 |
| 2,513,242 | 6/1950 | Inman | 219/10.51 |
| 3,053,959 | 9/1962 | Christmann | 219/10.49 |
| 3,936,625 | 2/1976 | Burnett | 219/10.51 |
| 4,145,591 | 3/1979 | Takeda | 219/10.49 R |

*Primary Examiner*—Volodymyr Y. Mayewsky

[57] ABSTRACT

Fluid placed in contact with each of a plurality of magnetizable cores is heated by application of alternating electrical current to an induction heating coil surrounding each magnetizable core, the coils being connected together in an electrical network. A core comprised of a cylinder containing magnetizable steel balls, when partially filled with water as a fluid, produces steam at an outlet for use in a heating system or to provide motive power. Air, as a fluid, when passed through a core comprised of a roll of magnetizable material, either a mesh screen, or sheet metal, is heated for use in a forced air heating system.

9 Claims, 10 Drawing Figures

ELECTROMAGNETIC INDUCTION ENERGY CONVERTER

BACKGROUND OF THE INVENTION

The present invention relates to energy conversion, and more particularly to the use of alternating electrical current to provide electromagnetic induction heating of a fluid for use in a home heating system or to provide motive power.

A great deal of activity is taking place to find alternatives for creating heat or motive power which lessens a dependency on oil, gas, or electricity usage. Some of the better known alternatives include solar heating, wood burning stoves, and the production of motive power utilizing electrical means. All of these systems have a dependency which prevents them from having universal use, such as a need for as much sun light as possible, and a supply of fire wood. With the use of electricity for motive power, there is a requirement to have available a source of charging current. Further, such items as solar panels and wood burning stoves requiring installation which may be unattractive or not completely desirable.

The use of electricity for home heating has increased, but the large amount of electricity consumed, and therefore cost of this heating, has become unattractive. One method of creating heat from electricity is to provide resistive elements, but this has resulted in large consumption. Another form of heating utilizing electricity is electromagnetic induction heating. The placement of magnetizable material in the magnetic field of an induction coil powered by alternating electrical current is used for producing heat in many industrial applications.

SUMMARY OF THE INVENTION

A primary object of the present invention is to provide an energy converter which can be connected to a readily available source of alternating electrical current to provide heat by electromagnetic induction techniques for heating a fluid to a temperature suitable for use in a home heating system or to produce motive power.

One specific object of the present invention to utilize house electrical current to provide electromagnetic induction heating of water to produce steam for use in a home heating system.

Another specific object of this invention is to utilize house electrical current to provide electromagnetic induction heating of air for use in a forced air heating system.

A further object of this invention is to provide motive power utilizing electromagnetic induction heating to heat water to produce steam from a readily available source of electrical power, namely a d.c. battery.

These and other features, objects and advantages are achieved by providing a plurality of magnetizable cores, each provided with an inlet for fluid to be heated, and an outlet, and each being surrounded by an induction heating coil, the coil being connected in an electrical network and in turn being connectable to a readily available source of alternating electrical current such as the standard 110 volt, 60 cycle house electrical current.

When the magnetizable core is comprised of cylinder filled with magnetizable steel balls, and water, as a fluid, is presented at the inlet, the electromagnetic induction heating of the magnetizable steel balls raises the temperature of the water to a point to cause boiling and the production of steam at the outlet of the core.

When the magnetizable core is comprised of a roll of magnetizable material such as sheet metal, or mesh screening, and alternating electrical current is applied to a surrounding induction heating coil, the temperature of the mesh screen or sheet metal rises to a point sufficient to heat air, as a fluid, forced through the roll of material.

The output of the energy converter which produces steam can be applied to a steam engine to provide motive power, or presented to a heat exchanger of an existing steam heating system. When the energy converter is comprised of cores made of rolls of magnetizable material, a plurality of these can be mounted within the plennum of a normal hot air furnace to provide an alternative to oil heated air. In another embodiment of the present invention, there is shown the use of a roll of magnetizable material as a core, surrounded by an induction coil, and manufactured as part of a section of hot air heating duct. This section can be inserted in an existing hot air duct system to provide a booster or supplement for air heated by the standard oil-fired furnace.

DETAILED DESCRIPTION OF THE INVENTION

General Information

The concept of induction heating is well known. When an alternating electrical current is applied to a coil of wire, a magnetic field is created, the polarization of which alternates with the alternations of the electrical current. If a magnetizable metal is placed in the alternating magnetic field of the coil, the molecules of the metal will change orientation to follow the alternating magnetic field. The movement of the molecules of the metal creates friction, and thus heat. If a fluid is placed in contact with the magnetizable metal core within the alternating magnetic field, the heat produced by the friction created in the magnetic field, will heat the fluid.

Steam Generating Energy Converter

Figure 1:
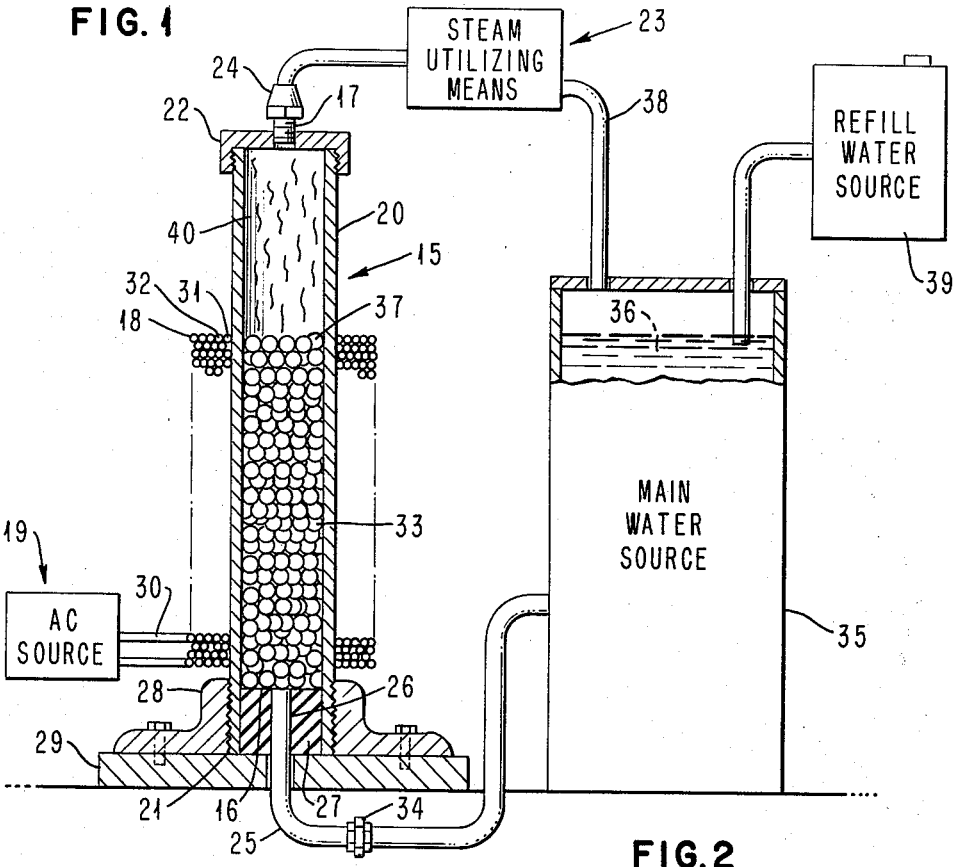
FIG. 1 is a schematic representation of an energy converter for creating steam by the electromagnetic induction heating of water fed to the inlet of a cylinder filled with magnetizable steel balls.

FIG. 1 depicts a first embodiment of the present invention wherein the fluid to be heated is water and the construction is such that steam will be created. The basic components to be described in FIG. 1, and shown in all remaining figures and embodiments, include a magnetizable core, identified generally as 15, which includes an inlet 16 for a fluid, an outlet 17, an induction heating coil 18, and a source of alternating electrical current noted generally at 19.

In FIG. 1, the magnetizable core 15 is comprised of a hollow container 20 having an inlet 21, a cap 22 which provides the outlet 17 connected to steam utilizing means, noted generally at 23, by suitable coupling 24. At the inlet end 21, an inlet pipe 25 is inserted through a hole 26 in a rubber or cork plug 27, which in turn is inserted into the inlet end 21 of the container 20. External threads on the inlet end 21 of the container 20 permit placement of a threaded flange 28 on the lower end 21 of the container 20. By means of suitable connecting means, the flange 28 and container 20 can be mounted to a base 29. The connection of the flange 28 to the base 29 provides suitable pressure to firmly seat the plug 27 in the interior of the container 20.

In a preferred embodiment of the present invention for creating steam, the induction heating coil 18 is comprised of five layers of #20 TEFLON wire 30. TEFLON is a Trademark of the E. I. du Pont Co. All of the turns of the coil 18 must be in the same direction. Therefore, after completing the first layer 31 of the coil, the wire 30 must be run straight down to the beginning of the coil before commencing the creation of the second layer 32 and all subsequent layers.

The magnetizable material to be placed within the magnetic field of the coil 18 are a quantity of ⅛th inch ball bearings 33. Through suitable connection 34 to the inlet pipe 25, a main water source 35 provided with a quantity of water at level 36 will cause water to flow through the configuration of ball bearings 33 to the level 37. Condensation from the steam utilizing means 23 can be returned through piping 38 to the main water source 35. To maintain the water at the level 36, a refill water source 39 is provided, utilizing any suitable means to detect when the level 36 is too low, to provide additional water to achieve the level 36.

In accordance with the previously discussed concept of electromagnetic induction heating, application of the alternating current source 19 to the coil 18, and the subsequent reversing orientation of the molecules in the ball bearings 33 creates sufficient friction, and therefor heat, to raise the temperature of the water in the steam generator 15 to create steam 40 for use by the steam utilizing means 23.

The steam utilizing means 23 can take several forms. To be discussed subsequently, this may be a steam engine for the creation of motive power. If the steam generating energy converter depicted in FIG. 1 is to be utilized in a steam heating system, the connecting pipe 24 can be applied directly to the steam heating system. If the heating system is either hot air or hot water, the connection 24 can be made to a steam utilizing means 23 comprised of any suitable heat exchanger for transferring the heat of the steam to air or water.

Although the alternating current source 19 could take many forms, the preferred embodiment of the invention shown in FIG. 1 can create steam 40 in response to heat produced by the ordinary 110 volt, 60 cycle house current. This is possible with construction of a magnetizable core 15 which includes a hollow, ¾ inch galvanized pipe for the container 20, and the previously mentioned five layers of #20 TEFLON wire producing a coil having a length of approximately two feet.

It should be readily apparent to those skilled in the art that these dimensions are not considered limiting. The amount of heat created by electromagnetic induction heating can be varied by changing the frequency of the alternating current source 19, changing the size of the wire 30, the height of the coil 18, and the number of layers 31, 32, etc.

Figure 2:
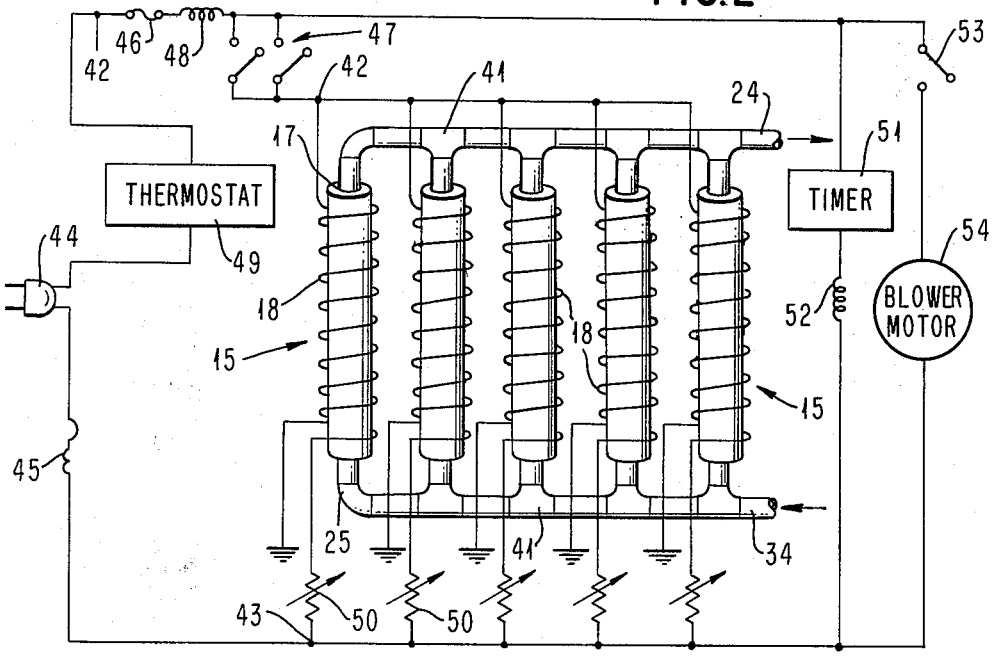
FIG. 2 is a schematic representation of the electrical and mechanical interconnection of a plurality of magnetizable cores and induction heating coils for connection to a thermostat controlled steam heating system.

FIG. 2 is a structural and electrical schematic of a preferred method of implementing a plurality of the electromagnetic induction steam generating elements shown in FIG. 1 into a home heating system. The inlet pipe 25 and the outlet 17 of a plurality of magnetizable cores 15 are connected by suitable pipe connections 41 to provide a single inlet 34 and a single outlet 24. The inlet 34 receives water from the main water source 35 shown in FIG. 1, and the outlet 24 for steam is applied to the steam utilizing means 23 of FIG. 1.

The induction coil 18 of all of the magnetizable cores 15 are connected into a parallel electrical network connectable at poins 42 and 43 to a source of alternating electrical current. The remaining electrical components make up the alternating current source 19 shown in FIG. 1. These electrical components include a connection 44 to the 110 volt 60 cycle house current, a current circuit breaker 45, and an over-heat fuse 46 for sensing external heat produced by the cores 15. Connection of the house current at 44 to the network of induction coils 18 is accomplished by the closure of contacts 47 in response to energization of a relay coil 48, which is in turn energized when a temperature sensitive thermostat 49 directs that heat should be applied to the heating system.

In a preferred embodiment, variable resistors 50 are placed in the path of each of the induction coils 18 to provide approximately three amps of current in each of the induction coils 18. Each of the hollow containers 20 which comprise the magnetizable core 15 are grounded as at 50A.

Another portion of the electrical circuit shown in FIG. 2 includes a timer 51 which, after operation of the thermostat 49 energizes a relay coil 52, closing a contact 53 to energize the blower motor 54 associated with a hot air furnace. The timer 51 provides a time out of approximately 5 minutes to allow the heat exchanger connected to the steam outlet 24 to create sufficient heat in a hot air system before energizing the blower motor 54.

Figure 3:
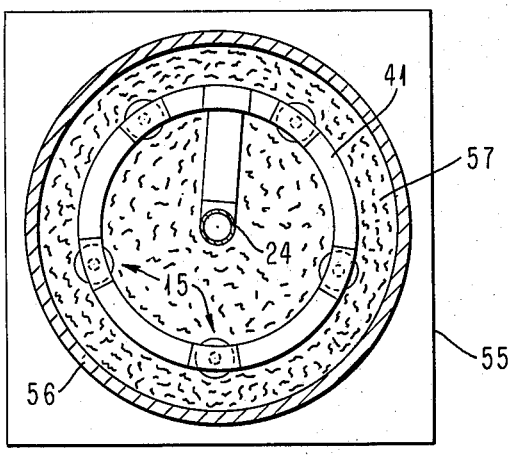
FIG. 3 is a plan view of a unitary structure comprised of a plurality of magnetizable cores for providing steam in accordance with the present invention.
Figure 4:
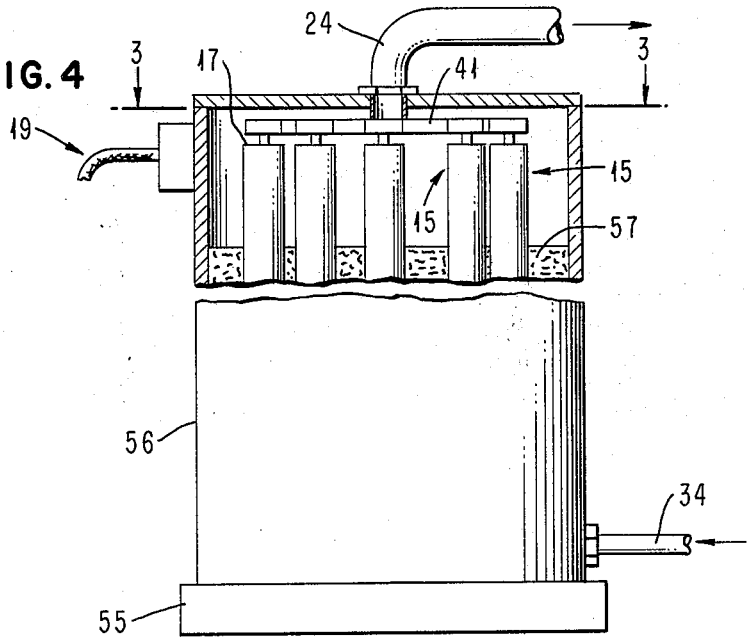
FIG. 4 is an elevation view of the unitary structure shown in FIG. 3.

FIGS. 3 and 4 show a plan and elevation view respectively of a suitable enclosure for the plurality of magnetizable cores depicted in FIGS. 1 and 2. The enclosure includes a base 55 to which is attached a covered cylinder 56 having an approximate three foot length and twelve inch diameter. The single water inlet 34 is shown as well as the single steam outlet 24. The magnetizable cores 15 are arranged in a circular fashion within the enclosure 56. The individual steam outlets 17 are connected together through suitable piping connection 41 to the single outlet 24. To provide better heating efficiency, insulation 57 is placed within the enclosure 56 to surround each of the magnetizable cores 15.

It can be seen from FIGS. 3 and 4, that the plurality of electromagnetic cores configured to produce steam can be easily and inexpensively housed in a unit of very reasonable size. This makes use of the present invention attractive for installation in almost any home environment.

Figure 5:
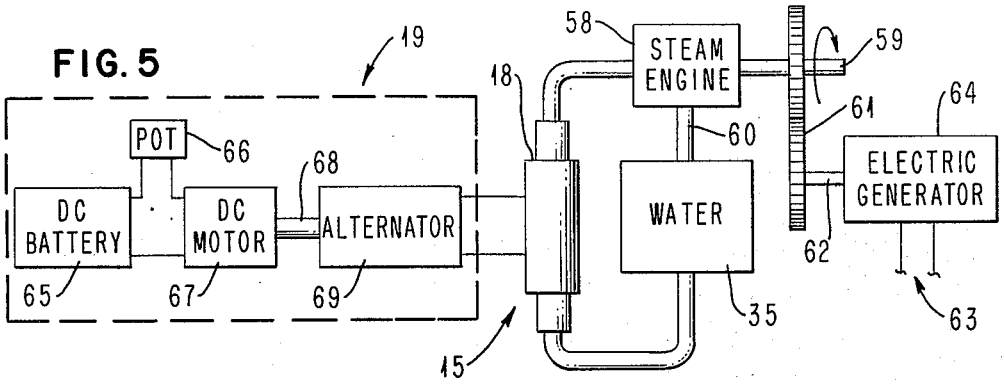
FIG. 5 is a representation of the use of a steam generating energy converter utilizing electromagnetic induction heating starting with electrical energy from a d.c. battery, and where motive power is produced, including the generation of further electrical energy.

FIG. 5 shows an embodiment of the present invention wherein the magnetizable core 15 for producing steam is implemented to provide motive power. The steam produced by the electromagnetic core 15 can be applied to a steam engine 58 which provides a power output shaft 59. Depending on the load applied to the shaft 59, one or more of the electromagnetic cores 15 can be interconnected in accordance with FIG. 2 to provide sufficient steam to the steam engine 58. The water reservoir 35 is shown connected to the electromagnetic core 15 and receives condensation at 60 from operation of the steam engine 58. The power shaft 59 could be utilized to provide motive power to a vehicle. As a minimum, suitable gearing 61 could be provided to rotate a shaft 62 for creating electrical power at 63 from an electric generator 64. The output of electric generator 64 could be utilized for the purpose of recharging batteries utilized, for example, in an electric powered car.

In FIG. 5, the alternating current source, noted generally at 19, could include a d.c. battery 65 connected through a potentiometer 66 to a d.c. motor 67. By means of a shaft 68 which turns an alternator 69, alternating electrical current is created for application to the coils 18 of the magnetizable core 15. Utilizing a potentiometer 66 which can be adjusted from off to some maximum value, the speed of the d.c. motor 67 can be controlled, and thus the frequency of the alternating current output of the alternator 69. In accordance with basics of induction heating, the amount of heat created within the magnetizable core 15 is a function of the frequency of the current applied to the coils 18. Therefore, the amount of steam produced, and therefore speed at which the steam engine 58 operates can be controlled.

Figure 6:
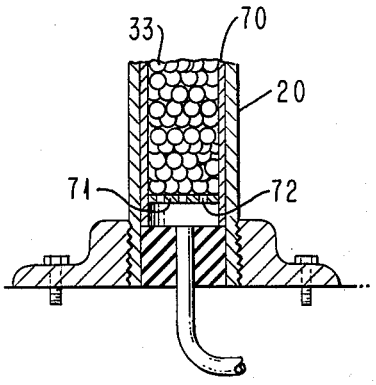
FIG. 6 is a representation of an alternative form of the steam generator shown in FIG. 1, providing a means for replacing the magnetizable steel balls within the cylinder.

It is assumed that continued use, and therefore alternating magnetization of the steel balls 33, may cause them to lose effectiveness. Therefore, a modification to the container 20 shown in FIG. 1, is shown in FIG. 6. Added to the container 20 shown in FIG. 1 is an additional internal liner 70 having a bottom 71 including a plurality of holes 72. The magnetizable steel balls 33 are contained within the liner 70. If the steel balls 33 need replacement, the threaded cap 22 shown in FIG. 1 can be removed permitting removal of the liner 70, and new steel balls 33 inserted. The holes 72 in the bottom 71 permit flow of water into the interior of the liner 70 thus surrounding the steel balls 33.

Hot Air Generating Energy Converter

Figure 7:
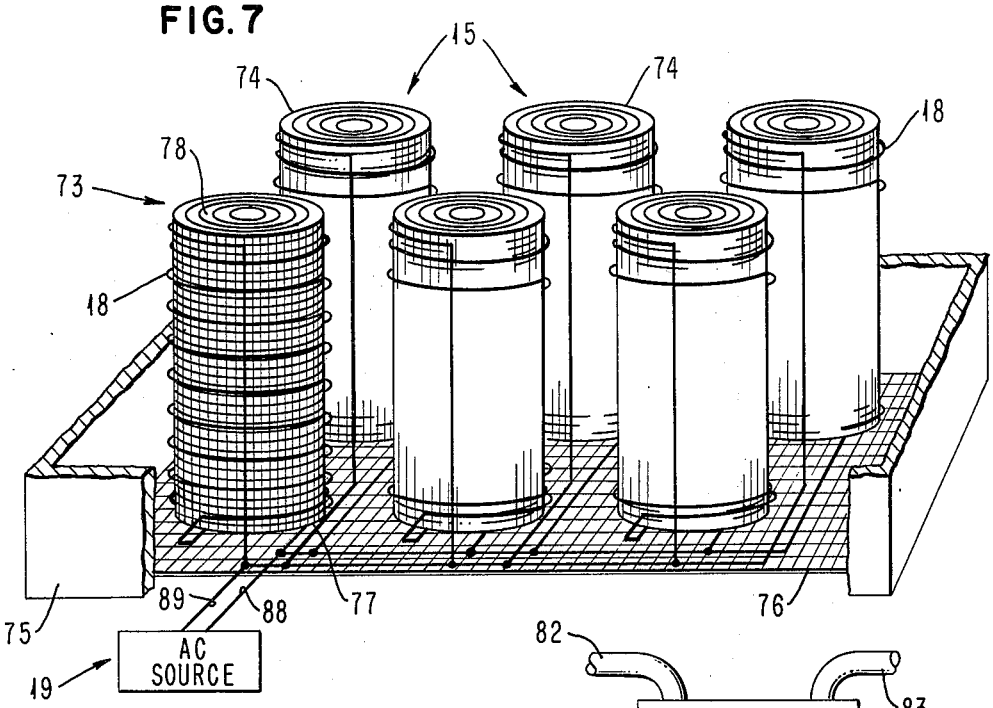
FIG. 7 is a schematic representation of another embodiment of a magnetizable core for heating a fluid comprised of a roll of magnetizable material permitting passage of air as a fluid through the apparatus for heating.

In FIG. 7, noted generally by the designation 73, there is shown an electromagnetic induction energy converter wherein the plurality of magnetizable cores 15 are comprised of a roll of magnetizable material, where the magnetizable material is a wire mesh screen 74, each surrounded by an induction coil 18. In the embodiment of FIG. 7, the fluid to be heated when the alternating current source 19 is applied to the network of coils 18, is air. The plurality or rolls of wire mesh screen 74 would be assembled within a frame member 75 having a bottom 76 made of wire mesh screen. Through the fan mechanism of a hot air heating system, air would be forced through the rolls of wire mesh screen from the bottom 77 of each screen comprising an input for the air, to a top 78 comprising an output of each of the rolls of wire mesh screen 74.

Figure 8:
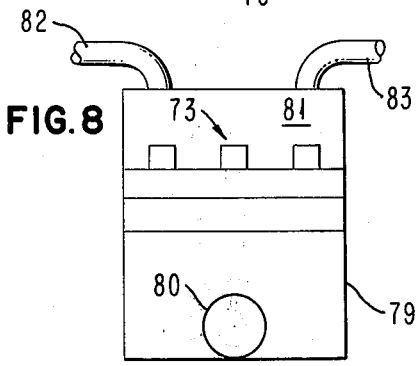
FIG. 8 is a representation of the placement of the apparatus of FIG. 7 in the plennum of a standard oil fired hot air furnace.

FIG. 8 depicts a hot air furnace 79 having an oil burner 80, a plennum area 81, a hot air input to the heating system 82, and a cold air return from the heating system 83. The hot air generating energy converter 73 would be placed in the plennum area 81 of the furnace 79 to provide a supplement to or substitute for the air heating capability of the oil burner 80.

Figure 9:
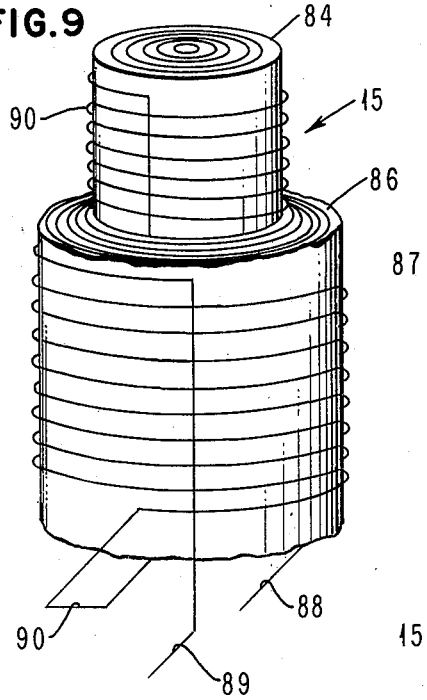
FIG. 9 is a schematic representation of a magnetizable core comprised of a first roll of magnetizable sheet metal surrounded by an induction coil, surrounded by a second roll of sheet metal, in turn surrounded by an induction coil.

FIG. 9 depicts a preferred form for the creation of each of the rolls of magnetizable material that would comprise the hot air heating apparatus of FIG. 7. Each of the electromagnetic cores 15 is comprised of a first roll 84 of magnetizable sheet metal surrounded by a first induction coil 85, which is in turn surrounded by a second roll 86 of magnetizable sheet metal, which is further surrounded by a second induction coil 87. Referring to both FIGS. 7 and 9, the alternating current source 19 would provide two lines 88 and 89, and as depicted in FIG. 2, all of the induction coils 18 will be connected into a parallel electrical network.

Referring to FIG. 9, it will be assumed that the line 88 will first be utilized to create a layer of the coil 85 from the bottom to the top of the roll 84, with a return to the bottom to begin each of the required layers of the coil 85. After creating the required number of layers of the coil 85, a vertical portion 90 of the wire will be returned to the bottom of the roll 84 to commence the turns and layers of the second portion 87 of the coil after roll 86 is created. After completing the number of layers of the coil 87 required, connection will be made to the alternating current source line 89.

Whether the hot air heating apparatus 73 of FIG. 7 is created by rolls of magnetizable mesh screen as shown in FIG. 7, or by rolls of magnetizable sheet metal as shown in FIG. 9, it has been found that, in addition to rolls 84 and 86 with associated coils 85 and 87, three more layers of rolls and associated coils, is found most efficient. This configuration results in a magnetizable core with an approximate ten inch diameter.

It has also been discovered that the multiple layers of magnetizable rolls and surrounding coils creates a transformer action such that with an input from the alternating current source of 110 volts, a higher voltage, and thus watts of energy, is created.

Figure 10:
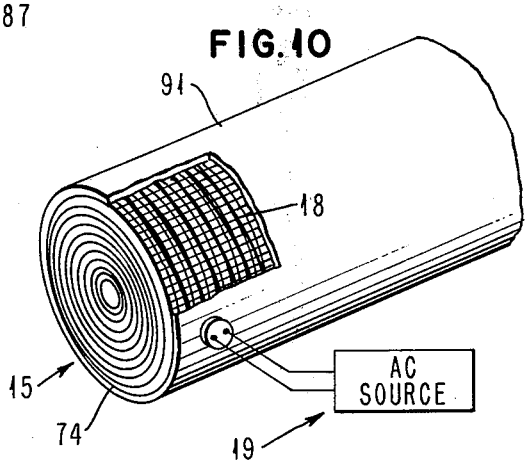
FIG. 10 is a schematic representation of a magnetizable core comprised of a magnetizable mesh screen formed within a section of a hot air duct.

FIG. 10 depicts a further adaptation or use for a magnetizable core 15 comprised of a roll of magnetizable material 74 including an induction coil 18. In hot air heating systems, it is known that sections of the hot air duct can be purchased with booster fans for the hot air duct system. The concept of the present invention can be adapted to create an additional heating factor to an existing oil fired hot air system. A single roll of magnetizable material 74 with its surrounding induction coil 18 can be enclosed in a section 91 of a hot air duct system. The section 91 can be inserted in any area of the hot air system requiring additional heating capability, and the alternating current source 19 applied thereto as required.

Having thus described my invention, what I claim as new and desire to secure by Letters Patent is:

1. An electromagnetic induction energy converter adapted for connection to a source of alternating electrical current including:

a plurality of magnetizable cores, each including an inlet for a fluid to be heated, and an outlet;

a source of fluid connected to each said inlet, effective to maintain the fluid in contact with each said magnetizable core without reaching said outlet; and an induction heating coil surrounding each of said cores, all of said coils being connected together in an electrical network connectable to a source of alternating electrical current whereby each of said plurality of magnetizable cores is heated to produce vapor at said outlet.

2. An electromagnetic induction energy converter in accordance with claim 1 wherein:

each said magnetizable core is comprised of;

a hollow container, and a plurality of magnetizable elements within said container configured to permit flow of a fluid to be heated in contact therewith.

3. An electromagnetic induction energy converter in accordance with claim 2 wherein:

said fluid is water, and said vapor is steam.

4. An electromagnetic induction energy converter in accordance with claim 3 wherein said converter further includes:

steam utilizing means connected to said single outlet.

5. An electromagnetic induction energy converter in accordance with claim 4 wherein:

said steam utilizing means is a heat exchanger.

6. An electromagnetic induction energy converter in accordance with claim 4 wherein:

said steam utilizing means is steam operated mechanical apparatus.

7. An electromagnetic induction energy converter in accordance with claim 3 wherein said converter further includes:

an enclosure surrounding all of said hollow containers;

insulation material within said enclosure and surrounding all of said hollow containers;

enclosure input means connected to said water source and said inlet of each of said magnetizable cores; and enclosure output means connected to said single outlet.

8. An electromagnetic induction energy converter in accordance with claim 2 wherein:

said plurality of magnetizable elements are ball bearings.

9. An electromagnetic induction steam generating element adapted for connection to a source of alternating electrical current comprising:

a hollow container having an inlet connectable to a source of water and an outlet connectable to steam utilizing means, a plurality of magnetizable elements in contact with each adjacent one within said container configured to permit water in said container to surround said plurality of magnetizable elements; and an induction heating coil surrounding said container, said heating coil being connectable to the source of alternating electrical current;

whereby introduction of water to said container until less than full, and energization of said induction heating coil will cause heating of said plurality of magnetizable elements to raise the temperature of the water to cause steam.

* * * * *